US005474010A

United States Patent [19]

Marcus

[11] Patent Number: 5,474,010

[45] Date of Patent: Dec. 12, 1995

[54] SAIL GATHERING SYSTEM

[76] Inventor: L. Gerald Marcus, 49 Fiske Rd., Wellesley, Mass. 02181

[21] Appl. No.: 314,668

[22] Filed: Sep. 29, 1994

[51] Int. Cl.[6] ..... B63H 9/04

[52] U.S. Cl. ..... 114/105

[58] Field of Search ..... 114/39.1, 101, 114/102, 103, 104, 105; 242/370, 16, 17, 147 R

[56] References Cited

U.S. PATENT DOCUMENTS

| | | | |
|---|---|---|---|
| 4,354,444 | 10/1982 | Puretic . | |
| 4,741,281 | 5/1988 | Doyle . | |
| 4,745,871 | 5/1988 | Weidar | 114/105 |
| 4,793,274 | 12/1988 | Regone | 114/254 |
| 5,119,750 | 6/1992 | Somers | 114/104 |
| 5,327,842 | 7/1994 | Bailey | 114/105 |

*Primary Examiner*—Stephen Avila
*Attorney, Agent, or Firm*—Henry D. Pahl, Jr.

[57] ABSTRACT

A dropped sail is gathered along a boom extending generally horizontally from a mast upon which the sail can be raised during sailing, the mast being supported by a lateral stays. On each side of the boom, a first line, when tensioned, extends from the free end of the boom to a point on a respective lateral stay above the boom. A second line, when slackened, extends from a point adjacent the proximal end of the boom to a self-determining point on the first line. Lacing line means are provided for forming a web-like gathering structure between the boom and the first line means when tensioned. Tensioning of the second line when the first line is slackened draws the first line toward the boom for collapsing the gathering structure.

12 Claims, 3 Drawing Sheets

SAIL GATHERING SYSTEM

BACKGROUND OF THE INVENTION

The present invention relates to a sail gathering system and more particularly a system for gathering a dropped sail along a boom which extends from a mast supported by lateral stays.

Various systems have been proposed heretofore for facilitating the furling of a mainsail on its boom when lowered from the supporting mast. A most common and very old such system is the one known as lazy jacks which typically comprise a series of branching lines extending from an intermediate point on the mast to several points along the boom. Well recognized disadvantages of the so-called lazy jack system, besides aesthetic detraction, is that the lines are deployed and creating windage and slatting during sailing and can frequently catch the ends of battens when the mainsail is being raised. Additionally, it is difficult to fold or otherwise re-arrange the sail for neatness within the tight confines of the lazy jacks. Finally, placement and securing of a sail cover is greatly complicated by the lazy jacks extending from boom to mast. Costly modification of the sail cover to accommodate is most often required.

Various systems have also been proposed in which a sail cover is somewhat deployed during the dropping of the mainsail to facilitate its being gathered. Examples of such newer systems are disclosed for in U.S. Pat. Nos. 4,354,444 and 4,741,281. These systems, however, have achieved limited popularity largely because the cover panels are present and obtrusive during sailing and some of the supporting lines present problems similar to those present in the lazy jack system.

Among the several objects of the present invention are the provision of a system for gathering a sail which greatly facilitates the furling of the sail on a boom; the provision of such a system which forms a hammock-like structure for catching a sail being dropped; the provision of such a system which collapses and is unobtrusive during sailing or when the sail has been secured along the boom; the provision of such a system which is easy to operate and which is of relatively simple and inexpensive construction. Other objects and features will be in part apparent and in part pointed out hereinafter.

SUMMARY OF THE INVENTION

The system of the present invention is operative to gather a dropped sail along a boom extending generally horizontally from a mast upon which the sail can be raised during sailing, the mast being supported by lateral stays. On each side of the boom is deployed a first line which, when tensioned, extends from the distal or aft end of the boom to a point on a respective lateral stay which is above the boom. A second line terminates in a ring through which the first line passes freely and, when slackened, extends from a point adjacent the forward or proximal end of the boom to a self-determining point on the tensioned first line. Tensioning of the second line when the first line has been slackened is operative to draw the first line toward the proximal end of the boom. Additional lacing line means are provided for forming a web-like structure between the boom and the tensioned first line means. Accordingly, when the first line is tensioned a structure is formed for gathering a sail when dropped. When the second line is tensioned and the first line slacked, the structure is collapsed alongside the boom.

BRIEF DESCRIPTION OF THE DRAWINGS

Corresponding reference characters indicate corresponding parts throughout the several views of the drawings.

DESCRIPTION OF THE PREFERRED EMBODIMENT

Figure 1:
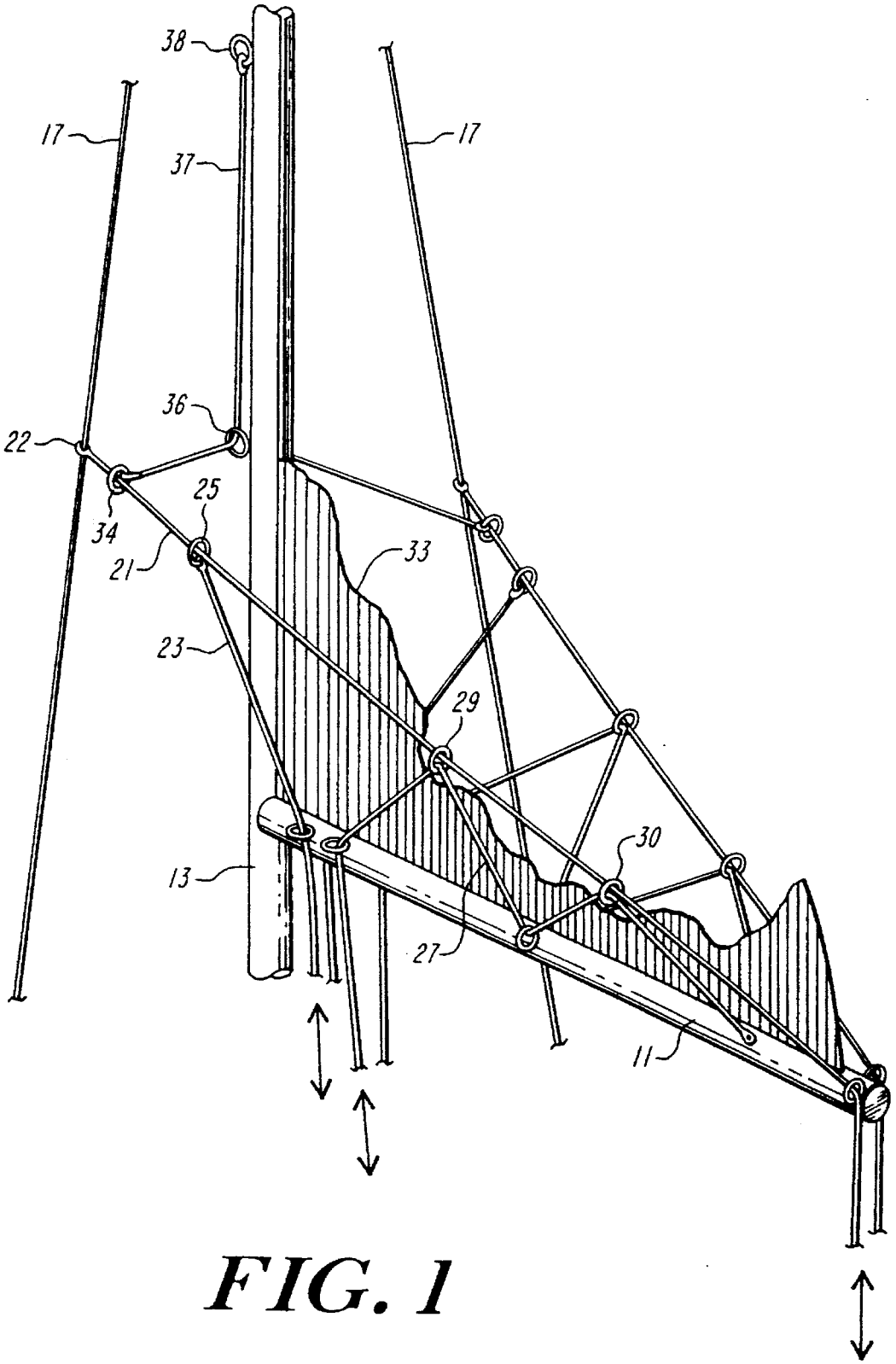
FIG. 1 is a diagrammatic illustration of sail gathering system in accordance with the present invention deployed for operation.

Referring now to FIG. 1, a generally horizontal boom 11 extends from a mast 13, the connection between the boom and mast being by way of a conventional gooseneck fitting which permits swinging of the boom. The end of the boom close to the mast is referred to hereinafter as the forward or proximal end of the boom while its other end is referred to as the distal or aft end.

Mast 13 is supported by a staying system in conventional manner. In cruising sail boats in the 25–45 foot range, to which the present invention is particularly applicable, the staying system will typically comprise outer stays which extend upward over spreaders to the top of the mast and inner stays or shrouds which extend directly from chain plates attached to the hull to an intermediate point on the mast, typically just under the spreaders.

As is explained in greater detail hereinafter the stays are utilized in deploying the mainsail gathering system disclosed herein and, in the preferred embodiment illustrated, attachment to the inner stays or shrouds is utilized. These are designated by reference character 17 in FIGS. 1 and 2. It should be understood, however, that the outer stays might be used in some circumstances.

As illustrated the gathering system is symmetrical and employs a similar arrangement of lines on either side of the boom. With reference to FIG. 1, where the system is shown deployed, a first line, designated by reference character 21, extends in tension between the distal end of the boom and an attachment point 22 on the respective shroud 17 which is substantially above the height of the boom. Provision is made for selectively tightening tensioning or slackening line 21. In the embodiment illustrated the line 21 preferably passes over a sheave at the distal end of the boom and its free end can be selectively secured or released through a suitable cleating system (not shown). An alternative would be to provide a sheave on pulley at the shroud and allow the line to be slackened or loosened from that end.

When the system is deployed as illustrated in FIG. 1, a second line 23 extends from a point adjacent the proximal end of the boom to a ring 25 through which the first line 21 passes freely. Thus, when the line 21 is tensioned and the line 23 is slackened, the ring 25 will self-seek a point along the line 21 where the lines 23 and 21 are essentially perpendicular. Provision is made for selectively tensioning or releasing each of the lines 23. While various simple cleating arrangements might be used, as will be understood by those skilled in the art, a presently preferred drum system is disclosed in greater detail hereinafter.

On each side of the boom 11, a third line 27 is provided which is, in effect, laced between fairleads on the boom or attached to the sail and rings 29 and 30 which are freely slidable along the first line 21. While two rings are shown, more or fewer could also be utilized. As will be understood, the purpose of the third or lacing line 27 is to further create a hammock-like structure which is adapted to receive a mainsail 33 being dropped from mast 13, so that the mainsail will be effectively gathered on top of the boom 11. Once the mainsail has been dropped it may be secured on the boom, either by a conventional sail cover or by lacing a further line through the attachment points for the built-in lacing line 27.

While lacing line 27 may be constructed of elastic cord e.g., of the type commonly referred to as bungee or shock cord, it is presently preferred to use a more conventional line which also includes provision for tensioning or releasing. The drum system described hereinafter which tensions or releases the lines 23 is preferably arranged so as to also tension or release the lines 27.

While rings, blocks and fairleads are specified at various points in this description, it should be understood that these designations are for the presently preferred embodiment and these components can for the most part be considered equivalent. Likewise, instead of being directly attached to the boom, the fairleads or sheaves could be indirectly attached, e.g. by mounting on the sail adjacent the boom.

Figure 2:
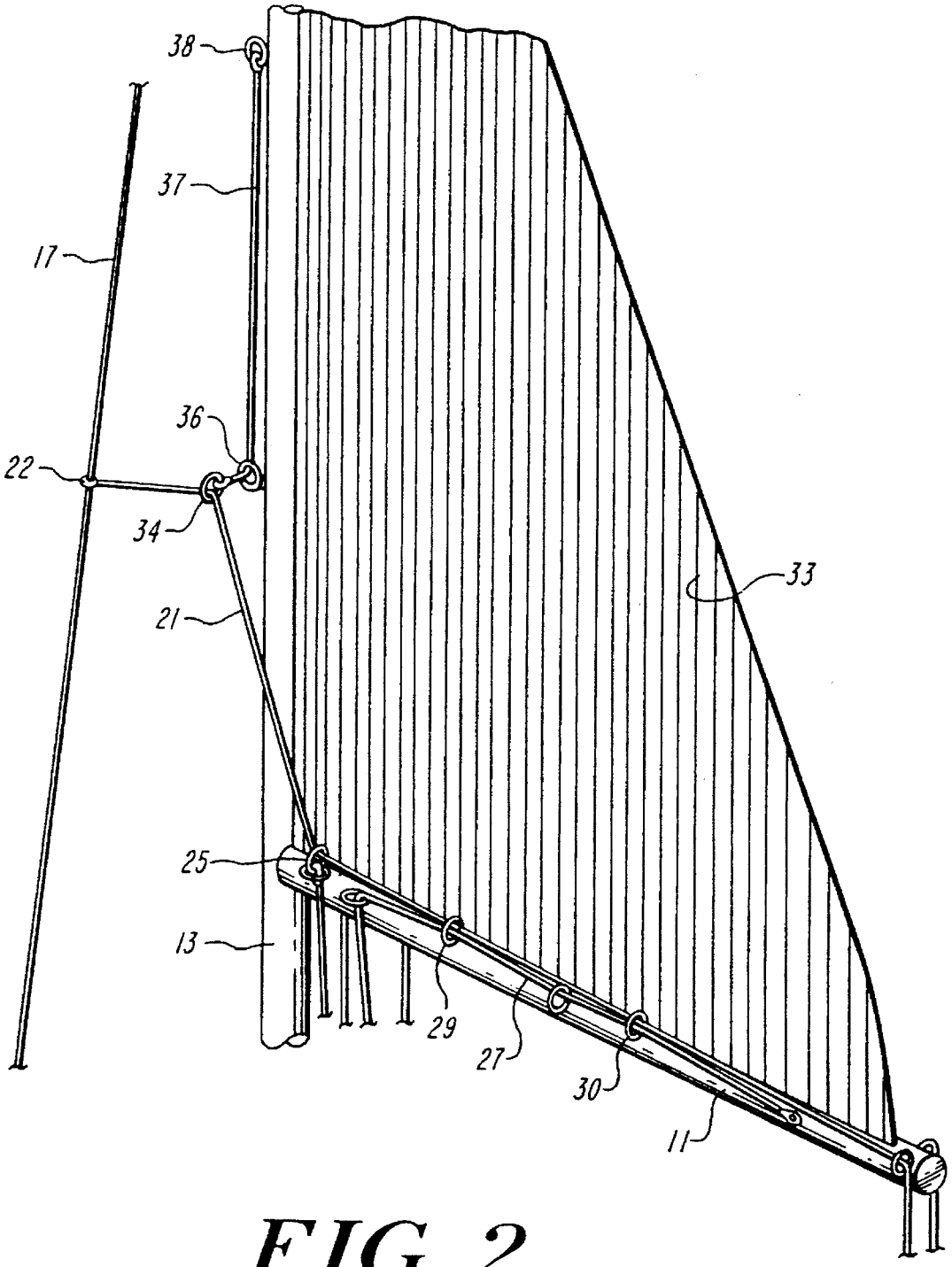
FIG. 2 is a diagram similar to FIG. 1 showing the sail gathering system collapsed and out of the way for sailing.
Figure 3:
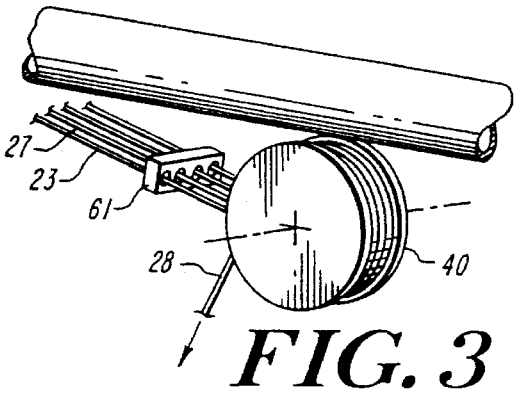
FIG. 3 illustrates a drum assembly which may be mounted under the boom of the system of FIGS. 1 and 2 for tensioning and slackening various lines used in the system.
Figure 4:
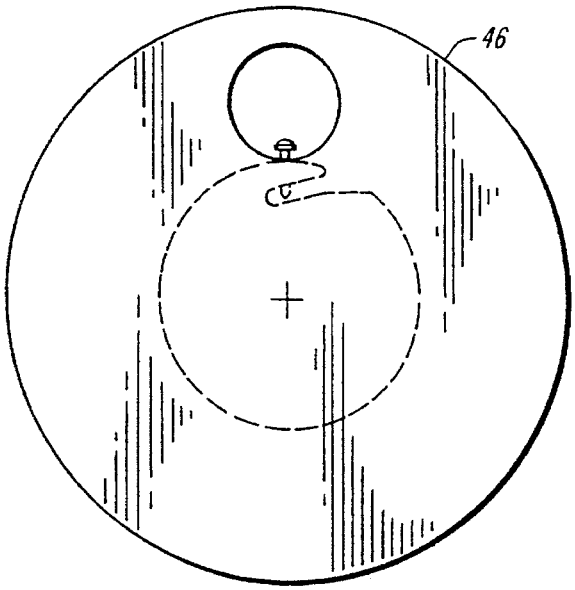
FIG. 4 is a plan view of the drum employed in the assembly of FIG. 3.
Figure 5:
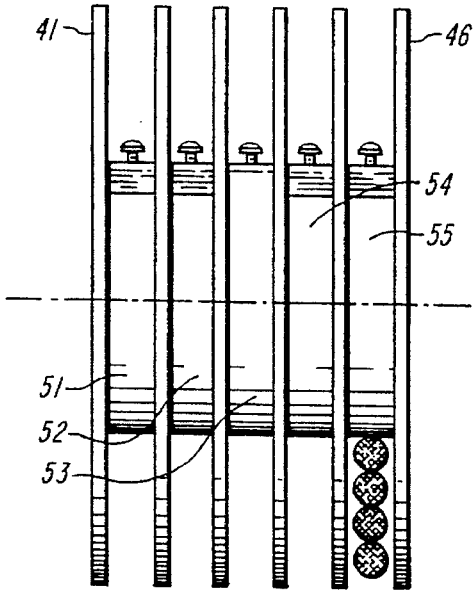
FIG. 5 is an edge view of the drum of FIG. 4.

During sailing or after the mainsail has been secured, the gathering system may be collapsed so as to be out of the way and inconspicuous allowing for the placement of a standard sail cover. To collapse the sail gathering structure, the lines 21 are slackened and the lines 23 and 27 are drawn in, e.g., by the drum system described in greater detail hereinafter. Tensioning of the line 23 will draw the first line 21 in close to the boom at its proximal end. While this line could extend directly from the shroud to this point, the preferred embodiment illustrated incorporates a mechanism for causing the slackened line 21 to first span essentially directly or horizontally across to the mast 13 and then proceed downwardly to the proximal end of the boom 11. As illustrated in FIGS. 1 and 2, this mechanism involves the length of bungee cord 37 which terminates in a ring or block 34 through which the line 21 passes freely. The bungee cord 37 then extends from the line 21 through a sheave or fairlead 36 on the mast, at about the same height as the attachment point 22 between line 21 and the shroud, and then upward or downward (choice) to an attachment point 38 which provides a length of the elastic cord providing sufficient expandability. Accordingly, when the line 21 is slackened and the line 23 is tensioned, the elastic cord 37 contracts and the upper portion of line 21 is caused to extend first to the mast 13 and then downwardly to the proximal end of the boom 11. This collapsed arrangement of the gathering system is illustrated in FIG. 2.

A preferred drum system for tensioning and slacking the lines 23 and 27 is illustrated in FIGS. 3–7. Journaled under the boom 11 by means of suitable brackets (not shown) is a partitioned reel or drum assembly 40. As illustrated, drum assembly 40 is made up of six larger diameter disks 41–46 separated by five smaller spacer disks 51–55. Preferably the spacing between the larger disks is only slightly wider than the width of the cordage used for lines 23 and 27 so that these lines will line up spirally without jamming. As viewed from the port or left side, each of the lines 23 and 27 are wound counterclockwise in respective slots and a pull line 28 is wound clockwise in the middle slot. This pull line will typically pass through a sheave at the base of the mast and then proceed to a point where manual hauling can be easily effected. As can be understood, pulling on the line 28 will cause the other four lines to be drawn in, as described earlier, collapsing the sail gathering system. Preferably the lines 23 and 27 pass through a quad fairlead 61 mounted close to the drum so as to guide each of the four lines into its respective drum slot.

Figure 6:
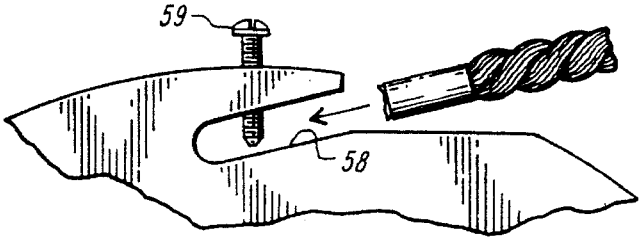
FIG. 6 illustrates a line attachment detail of the drum of FIG. 4.
Figure 7:
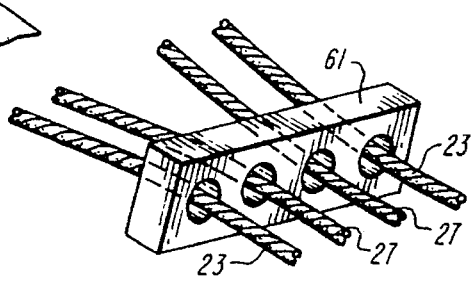
FIG. 7 illustrates a fairlead employed in the drum assembly of FIG. 3.

As illustrated in FIG. 6, each of the spacer disks are provided with an angled notch 58 for receiving the end of the respective line and a screw 59 is provided for securing that end. As will be understood from the preceding, the middle disk 53 will be reversed as compared with the other four so as to accommodate the reversed winding of the pull line 28.

In view of the foregoing it may be seen that several objects of the present invention are achieved and other advantageous results have been attained.

As various changes could be made in the above constructions without departing from the scope of the invention, it should be understood that all matter contained in the above description or shown in the accompanying drawings shall be interpreted as illustrative and not in a limiting sense.

What is claimed is:

1. A system for gathering a dropped sail along a boom extending generally horizontally from a mast upon which the sail can be raised during sailing, the mast being supported by lateral stays; said gathering system comprising on each side of said boom:

a first line which, when tensioned, extends from the distal end of said boom to a point on a respective lateral stay which is at a height substantially above said boom;

a second line terminating in a ring through which said first line passes freely and which, when slackened, can extend from a point adjacent the proximal end of said boom to a self determining point on said first line when tensioned, tensioning of said second line when said first line is slackened being operative to draw said first line toward the proximal end of said boom; and lacing line means for forming a web between said boom and said first line means when tensioned, whereby when said first line is tensioned a structure is formed for gathering said sail when dropped and, when said second line is tensioned and said first line is slackened, said structure is collapsed along said boom.

2. A sail gathering system as set forth in claim 1 including means for drawing each said first line to a point on said mast at about the same height as said point on the respective lateral stay, when said first line is slackened.

3. A sail gathering system as set forth in claim 2 wherein said drawing means comprises a length of elastic cord passing through a sheave on said mast.

4. A sail gathering system as set forth in claim 1 wherein said first line is selectively tensioned or slackened from the distal end of said boom.

5. A sail gathering system as set forth in claim 1 wherein said second line and said lacing line means can be selectively tensioned or slackened from a drum assembly mounted under said boom.

6. A sail gathering system as set forth in claim 5 wherein said drum assembly includes a drum having at least five partitions, one of which receives a draw line, two of which receive respective ones of said second lines and two of which receive respective ones of said lacing line means.

7. A sail gathering system as set forth in claim 1 wherein said lacing line means comprises lengths of elastic cord.

8. A system for gathering a dropped sail along a boom extending generally horizontally from a mast upon which the sail can be raised during sailing, the mast being supported by lateral stays; said gathering system comprising on each side of said boom:

a first line which, when tensioned, extends from the distal end of said boom to a point on a respective lateral stay which is at a height substantially above said boom;

a second line terminating in a ring through which said first line passes freely and which, when slackened, can extend from a point adjacent the proximal end of said boom to a self determining point on said first line when tensioned, tensioning of said second line when said first line is slackened being operative to draw said first line toward the proximal end of said boom;

a partitioned drum journaled under said boom and having a pair of partitions for receiving said second lines and a partition for receiving a pull line, said second lines being tensioned when said pull line is pulled; and lacing line means for forming a web between said boom and said first line means when tensioned, whereby when said first line is tensioned a structure is formed for gathering said sail when dropped and, when said second line is tensioned and said first line is slackened, said structure is collapsed along said boom.

9. A system for gathering a dropped sail along a boom extending generally horizontally from a mast upon which the sail can be raised during sailing, the mast being supported by lateral stays; said gathering system comprising on each side of said boom:

a first line which, when tensioned, extends from the distal end of said boom to a point on a respective lateral stay which is at a height substantially above said boom;

a second line terminating in a ring through which said first line passes freely and which, when slackened, can extend from a point adjacent the proximal end of said boom to a self determining point on said first line when tensioned, tensioning of said second line when said first line is slackened being operative to draw said first line toward the proximal end of said boom; and third line means extending from said mast at a height essentially equal to the height of attachment of the respective first line to the respective lateral stay and terminating in a ring through which said first line passes freely, said third line means being adapted to lead said first line to said mast when said first line is slackened;

lacing line means for forming a web between said boom and said first line means when tensioned, whereby when said first line is tensioned a structure is formed for gathering said sail when dropped and, when said second line is tensioned and said first line is slackened, said structure is collapsed along said boom.

10. A system for gathering a dropped sail along a boom extending generally horizontally from a mast upon which the sail can be raised during sailing, the mast being supported by lateral stays; said gathering system comprising on each side of said boom:

a first line which, when tensioned, extends from the distal end of said boom to a point on a respective lateral stay which is at a height substantially above said boom;

a second line terminating in a ring through which said first line passes freely and which, when slackened, can extend from a point adjacent the proximal end of said boom to a self determining point on said first line when tensioned, tensioning of said second line when said first line is slackened being operative to draw said first line toward the proximal end of said boom; and third line means extending from said mast at a height essentially equal to the height of attachment of the respective first line to the respective lateral stay and terminating in a ring through which said first line passes freely, said third line means being adapted to lead said first line to said mast when said first line is slackened;

lacing line means for forming a web between said boom and said first line means when tensioned, a partitioned drum journaled under said boom and having a first pair of partitions for receiving said second lines, a second pair of partitions for receiving said lacing line means, and a partition for receiving a pull line, said pull line being wound in the opposite direction from the other lines, whereby when said first line is tensioned a structure is formed for gathering said sail when dropped and, when said pull line is tensioned and said first line is slackened, said structure is collapsed along said boom.

11. In a system for selectively tensioning or slackening a plurality of lines which form a web line sail gathering structure and which must be drawn in simultaneously and repeatably, a tensioning drum system comprising:

a unitary rotatable drum providing at least five axially spaced partitions which rotate together, the central partition being adapted to receive a first line spirally wound in one rotational direction and the other partitions being adapted to receive lines wound in the opposite rotational direction whereby, when said first line is drawn off said central partition, the other lines are drawn into the other partitions simultaneously and repeatably.

12. A drum system as set forth in claim 11 wherein each of said partitions is essentially as wide as the diameter of the respective line to be received therein so that said line winds spirally.

* * * * *